US005947394A

United States Patent [19]

Egan, III et al.

[11] Patent Number: 5,947,394

[45] Date of Patent: Sep. 7, 1999

[54] PAPER PULP REFINER CONTROL SYSTEM AND METHOD

[75] Inventors: John J. Egan, III, Centerville; Christopher L. Demler, Lebanon, both of Ohio

[73] Assignee: Thermo Black Clawson Inc.

[21] Appl. No.: 09/169,914

[22] Filed: Oct. 9, 1998

Related U.S. Application Data

[60] Provisional application No. 60/061,491, Oct. 9, 1997.

[51] Int. Cl.[6] ..... B02C 7/16

[52] U.S. Cl. ..... 241/30; 241/37; 241/261.2; 241/297

[58] Field of Search ..... 241/30, 275, 37, 241/261.2, 261.3, 296, 297, 298; 162/254; 310/90.5; 318/632

[56] References Cited

U.S. PATENT DOCUMENTS

| | | | |
|---|---|---|---|
| 2,666,368 | 1/1954 | Staege et al. . | |
| 2,986,434 | 5/1961 | Baxter . | |
| 3,506,199 | 4/1970 | Hayward . | |
| 4,171,101 | 10/1979 | Seifert et al. . | |
| 4,179,075 | 12/1979 | Rachais | 241/275 |
| 4,253,053 | 2/1981 | Ray et al. . | |
| 4,348,619 | 9/1982 | Ray et al. . | |
| 5,347,190 | 9/1994 | Lewis et al. . | |
| 5,385,007 | 1/1995 | Hartel et al. . | |
| 5,386,166 | 1/1995 | Reimer et al. . | |
| 5,469,039 | 11/1995 | Stephenson et al. . | |
| 5,514,924 | 5/1996 | McMullen et al. . | |
| 5,530,306 | 6/1996 | Ueyama . | |
| 5,548,173 | 8/1996 | Stephenson . | |
| 5,565,722 | 10/1996 | Rubner et al. . | |
| 5,625,240 | 4/1997 | Bernus . | |

OTHER PUBLICATIONS

Kosow, Irving L., "Electric Machinery and Control" pp. 272–277 (date unknown).

*Primary Examiner*—Mark Rosenbaum
*Attorney, Agent, or Firm*—Biebel & French

[57] ABSTRACT

A rotary paper pulp refiner system and method includes a rotor having one or more refining elements mounted on a rotating shaft and complimentary non-rotating or stator elements defining with the rotating element a refining gap or gaps through which the paper stock material passes, and which the rotor is mounted for rotation on magnetic bearings that support the rotor shaft for rotation and define the axial and radial running position thereof. Optionally, a movable stator housing wall may also be controlled by a magnetic bearing.

9 Claims, 1 Drawing Sheet

PAPER PULP REFINER CONTROL SYSTEM AND METHOD

PRIOR PROVISIONAL APPLICATION

Applicant claims the benefit of the filing date of Provisional Application Ser. No. 60/061,491, filed Oct. 9, 1997.

This invention relates to an improved paper pulp refiner system, and method for the control of the position of the relatively rotating elements of a refiner.

BACKGROUND OF THE INVENTION

Cellulosic fibers such as paper pulp, bagasse, insulation or fiber board materials, cotton and the like, are commonly subjected to a refining operation which consists of mechanically rubbing the fiber between sets of relatively rotating bar and groove elements. In a disk-type refiner, for example, these elements commonly consist of plates having annularly arranged bar and groove patterns defining their working surfaces, with the bars and grooves extending generally radially of the axis of the rotating element, or more often at an angle to a radius to the center of the annular pattern, so that the stock can work its way from the center of the pattern to its outer periphery.

Disk-refiners are commonly manufactured in both single and twin disk types. In the former, the working surface of the rotor comprises an annular refiner plate, or a set of segmental refiner plates, for cooperative working action with a complementary working surface on the stator which also comprises an annular plate or a series of segmental plates forming an annulus. In a twin disk refiner, the rotor is provided with working surfaces on both sides which cooperate with a pair of opposed complementary working surfaces on the stator, with these working surfaces being of the same type of construction as with a single disk refiner.

Paper pulp refiners as described and including the plug or cone type, require the control of the position and spacing of the relatively rotating members, for the purpose of controlling refiner load and for controlling the quality of the refined paper fiber product, among other reasons. A plug type refiner is shown in Staege et al., U.S. Pat. No. 2,666,368, while a control arrangement for a dual inlet disk type refiner is shown in Hayward U.S. Pat. No. 3,506,199.

Traditionally, the control of refiners, resulting in the micrometer movement of one relatively moving refiner element with respect to another, has been accomplished by control systems which have electromechanical drives. While the control of the drives may be electrical or electronic such as shown in Hayward, in response to motor load, changing voltage or power factors, or pulp quality, the ultimate drive is by and through a gear reduction or high ratio mechanical positioning arrangement. In this connection, reference may be had to the Baxter U.S. Pat. No. 2,986,434 which shows a dual inlet radial disk type refiner and the reduction gearing through which the axial position of the stator and rotor elements may be accurately determined and maintained. For proper operation, not only is it necessary to control the relative position of the rotor members, it is also necessary to control the overall spacing between pairs of rotating and stationary refiner plates to compensate for plate wear and/or compensate for bearing wear or other parameters. As noted, such compensations have been made through mechanical or electro-mechanical gear or mechanical reduction type adjustments.

There has been no effective means by which the center of rotation of the rotating member can be shifted, adjusted or compensated in use except by making major set up changes in the alignment of the components. Accordingly, precise geometric control over and between the running relation of the rotary to the stationary member has never been fully available, during operation. Typically, while new refiners are manufactured to plus or minus 1 or 2 thousandths of an inch total run out or tolerance, most of these refiners actually run from 10 up to 20 or more thousandths of an inch out of alignment. Such non-alignment results in a reduction of pulp quality. Also, it is current practice in double disk refiners to allow the rotor to float and find its own position between non-rotating or stator elements. The success of such arrangements depends upon a maintenance of hydraulic balance but, from a practical point of view, such rotors tend to hunt back and forth between limit positions in which the rotor elements may come into actual contact with the stator refining elements.

SUMMARY OF THE INVENTION

This invention relates to a improved refiner system and a control system by which the precise location or position of the relatively rotating members may be determined, controlled and maintained during operation. This is accomplished in this invention by the use of magnetic bearings for supporting and positioning the rotor, and/or for positioning one or more of the stator components with respect to the rotor.

The arrangement permits the equalization of flow through a double refining system of a twin disk refiner by means of both axial and radial control. It features controllable electromagnetic bearings to control the axial position, by means of an external control loop, of the rotor assembly and/or of the stator assembly thereby providing direct control of the position of these components and increased stability of refiner operation.

Radial electro-magnetic bearings maintain a uniformity in the gaps in the circumferential sense and provide a means by which optimal alignment of the components may be maintained, or concentricity in the case of conical elements. They also permit asymmetrical running conditions to be maintained if desired.

As an added benefit, the use of concurrent axial and radial magnetic bearings provides two new degrees of freedom to the conventional system in that they provide for axial rotor orientation and simultaneous angular orientation with respect to a stator plane.

Additionally, the invention provides a refiner system and method by which the refiner may be tailored or modified to process pulps of different consistencies or different degrees of refinement by reason of the universality of the control as provided by the use of a combination of axial and radial magnetic bearings. Accordingly, process equipment which requires precise geometry control is enhanced in capability. The increase in process control has the effect of minimizing fiber damage or enhancing fiber processing rate. The flow through a pair of gaps in a twin disk system may be fully equalized as to power, draw or the like. Increased accuracy in plate adjustment is possible and greater turn down ratios are In a control system, the position of a rotor may be oriented with respect to one or more stator elements by using gap measuring techniques, as well known in the art, which the gap or gaps may be measured to provide a signal for controlling the rotor and/or one or more of the stators to maintain a desired gap or range of gaps. Also, on-line measurement of pulp quality may be employed as a control parameter.

From a mechanical and maintenance point of view, conventional bearing maintenance is eliminated. Magnetic bearings themselves are highly resistant to water contamination, which is always a threat and a problem with conventional mechanical bearings, and are resistant to small solids contamination that can quickly destroy a precision ball or roller bearing. Further in view of the substantial range of adjustments available, extremely close manufacturing and machining tolerances can be relaxed. Field adjustments and running adjustments may be maintained through appropriate software at the computer.

It is accordingly an important object of this invention to provide a paper pulp refiner which employs one or more magnetic bearings for position control. A single magnetic bearing may be used to provide a substantial improvement to the performance of the refiner.

Another object of the invention is to provide an apparatus and method by which a paper pulp refiner may be more accurately controlled and by which mechanical reduction in positioning elements commonly used for positioning control may be eliminated or simplified.

A still further object is the provision of a system, as outlined above, in which most or all of the conventional thrust and load carrying bearings and components may be eliminated and replaced with radial or axial thrust or combination magnetic bearings.

A further object of the invention is the provision of a refiner and method of operation in which the gap widths in a twin disk refiner or the like may be accurately maintained in an equalized condition of flow.

These and other objects and advantages of the invention will be apparent from the following description, the accompanying drawing and the appended claims.

BRIEF DESCRIPTION OF THE DRAWINGS

The FIGURE of the drawing represents a diagrammatic view of a twin disk refiner and control system according to this invention.

DETAILED DESCRIPTION OF THE PREFERRED EMBODIMENT

Figure 1:
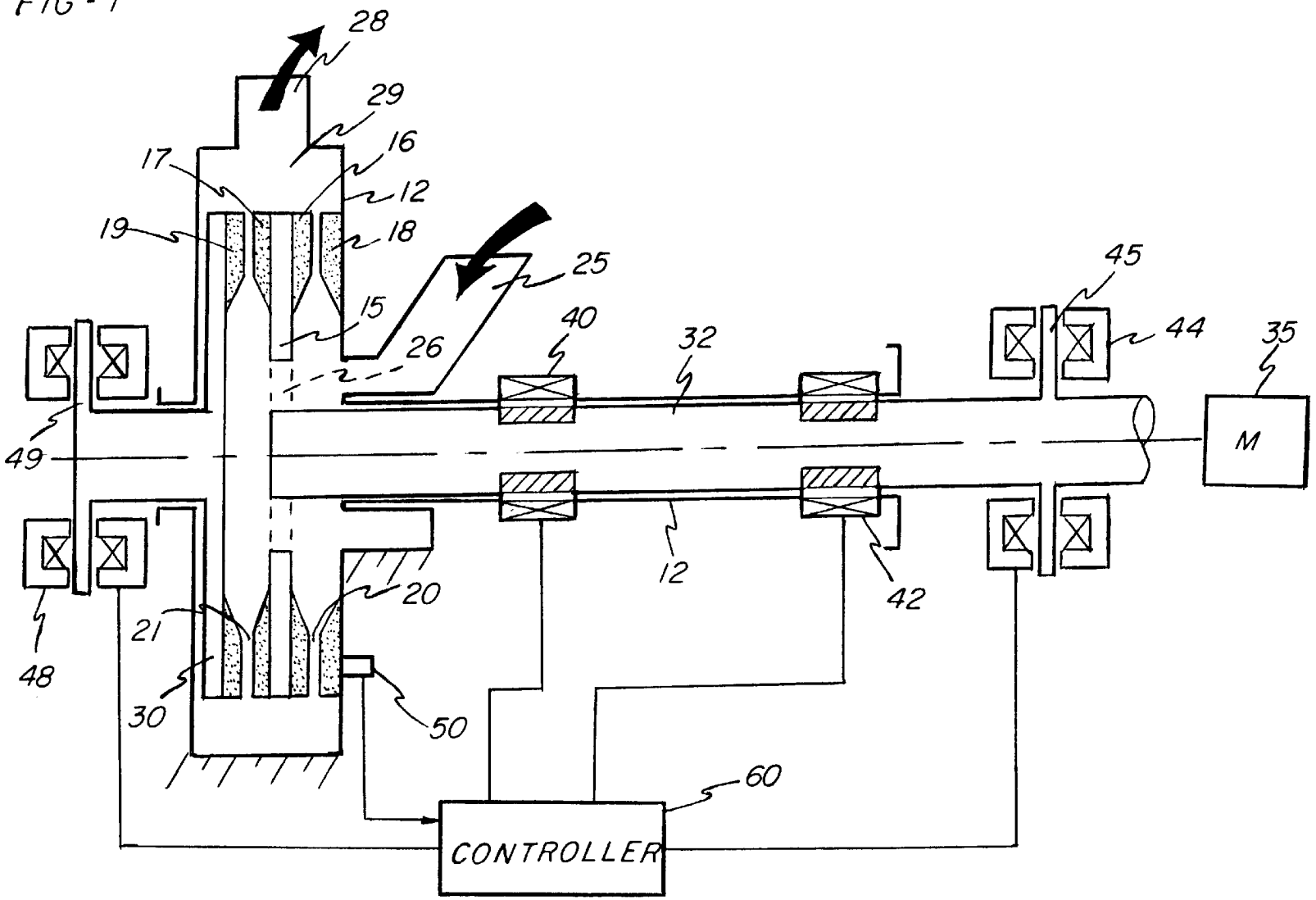

Referring to the drawing which represents a preferred embodiment of the invention, a twin disk refiner is shown in diagrammatic form. This refiner may be made in accordance with the patent of Seiffert et al., U.S. Pat. No. 4,171,101, the disclosure of which is incorporated herein by reference. While a twin disk refiner is used to illustrate the principles of the invention, it is understood that the invention may be applied to a single disk refiner, or to a plug type Jordan refiner such as shown in Staege et al., U.S. Pat. No. 2,666,368, or other conical type refiners.

The refiner 10 of FIG. 1 accordingly has a housing 12 and supports a central rotor 15 which carries on its radial surfaces a pair of oppositely facing refiner disk sets 16 and 17. These sets cooperate respectively with facing refiner disk sets 18 and 19 carried on the stator to define therebetween refiner gaps 20 and 21. A single inlet 25 may supply both of the refiner disk sets from a radially inner position, by providing a suitable passageway 26 through the rotor 15 or alternatively, separate inlets to the refiner may be provided as represented by the reference numerals 20 and 21 in patent '101. A common outlet 28 is formed to receive the refined pulp from the refiner gaps 20 and 21 and from the common chamber 29 defined by the housing 12.

The refiner disk set 18 is fixedly mounted on a wall of the housing 12 whereas the opposite non-rotating refiner disk set 19 is mounted on an axially positionable non-rotating housing member 30. The rotor 15 is connected to and driven by an input shaft 32 which, in turn, is driven by an electric drive motor 35. The drive motor 35 may be direct coupled to the shaft 32 or may be coupled through a flexible or universal coupling to permit the shaft 32 to be subjected to alignment and orientation to a certain degree separate from the shaft of the motor 35. Alternatively, the motor 35 may be belted to the shaft 32.

In the preferred embodiment a pair of radial type magnetic bearings 40 and 42 support the shaft 32 in the housing. The bearings 40 and 42 control the alignment of the plane of the rotor 15 and the rotor orbit.

A first axial magnetic bearing 44 includes an armature 45 joined with or mounted to the shaft 32 and receives the thrust of the shaft 32. The bearing 44 controls the axial position of the shaft and thereby controls the refining the width of the respective refining gaps 20 and 21. By this means, an equalized output condition can be maintained or, conversely, a controlled unequalized condition can be maintained in the refiner.

The refiner gap 21 and the gross spacing between the refiner disk sets 18 and 19 is controlled by regulating the axial position of the moveable stator housing member 30 by an additional axial thrust magnetic bearing 48 and its armature 49 which may be constructed the same as the bearing 44 and its armature 45. A gap pick up 50 may be used to measure and provide a signal of refiner gap.

The controllable magnetic bearings may be those as supplied by Revolve Technology, Inc., 300, 700-10th Avenue S.W., Calgary, Alberta, Canada T2R 0B3. Also, at least the radial bearing 42 and axial magnetic bearing 44 may be replaced by a single dual purpose magnetic bearing which provides for both radial and thrust control, such as shown in U.S. Pat. No. 5,514,924 or in U.S. Pat. No. 5,386,166. Further, it is understood that those persons skilled in the art have available control systems including a controller 60 by which the running clearances and gaps may be measured such as by the pick up 50, and the position of the rotor 15 including axial radial, and tilt or inclination, may be controlled by the controller 60 thereby suitably controlling the radial bearings 40, 42. Control systems for radial magnetic bearings are shown in U.S. Pat. Nos. 5,565,722, 5,530,306 and 5,347,190.

The axial bearing 44 may be employed in combination with the radial shaft supporting bearings 40, 42 to define and locate the relative axial position of the rotor 15 with respect to each of opposed stator members, while the second axial magnetic bearing 48 may be used to position the moveable housing member 30.

It will be therefore be seen that the usual complicated mechanical structure for supporting a refiner rotor and positioning the rotor through manual, remote or computer controlled motion reduction means has been eliminated. Similarly, the mechanical mechanism for moving or positioning one or more of the moveable refiner walls may be eliminated or simplified. Also, the system of this invention provides a wider range of operation and control since, for the first time in a refiner system, the radial running position or axial orientation of the drive shaft may be varied in use and during operation to optimize the refiner performance.

The benefits of this invention include improved pulp quality at lower cost, increased uniformity of treatment, reduced plate wear, wider operating flexibility and improved productivity.

While the method and form of apparatus herein described constitutes a preferred embodiment of this invention, it is to be understood that the invention is not limited to this precise method and form of apparatus, and that changes may be made therein without departing from the scope of the invention which is defined in the appended claims.

What is claimed is:

1. In a rotary refiner system including a mechanical refiner having an inlet for receiving a slurry to be refined and a discharge outlet for refined slurry and having a rotor shaft therein carrying at least one refiner element on said shaft, and having a stator with at least one complimentary refiner element mounted thereon and defining with said rotor refiner element a refining gap through which such slurry is refined moving from said inlet to said outlet, the improvement comprising a magnetic bearing supporting said rotor shaft for rotation and defining a running position of said rotor refiner element with respect to said stator refiner element, and means for controlling said magnetic bearing to control said refining gap therebetween.

2. The improvement of claim 1 further comprising a plurality of said magnetic bearings including magnetic bearings means controlling an axial running position of said shaft and means controlling a radial position of said shaft.

3. The improvement according to claim 2 in which said magnetic bearings includes a pair of radially controllable electromagnetic bearings supporting said shaft for rotation and defining the radial position of said rotor refining element, and at least one axial controllable magnetic bearing positioned to control the axial position of said rotor refining element.

4. The improvement of claim 3 further comprising a controller common to each of said magnetic bearings, a gap pick up on said refiner providing a signal of said refiner gap, and said gap pick up being connected to said controller whereby said controller operates to control said magnetic bearings in accordance with said refiner gap signal.

5. The improvement of claim 2 further including an additional said magnetic bearing mounted to control the position of said stator refiner element with respect to said rotor refiner element.

6. In a rotary refiner system for refining paper stock including a housing having a rotor therein including a generally radially extending refiner element mounted on a shaft in said housing, said housing further having a pair of non-rotating refiner elements mounted on axially opposed sides of said generally radially extending refiner element, in which said non-rotating refiner elements define with said generally radially extending refiner element gaps through which material passes in refining, an inlet leading into said housing through which paper stock material is applied into said gaps, and an outlet through which refined paper stock material flows from said housing, the improvement comprising at least a pair of magnetic bearings supporting said shaft with respect to said housing both as to radial and axial positions of said generally radial refiner element and providing for rotation thereof in said refiner gaps, and control means for controlling said magnetic bearings to define a desired axial and radial alignment of said generally radial refiner element with respect to said non-rotating refiner elements.

7. The method of controlling a paper stock refiner having at least a pair of non-rotating spaced apart refiner plates mounted thereon and having a rotor in which said rotor has refiner plates mounted thereon between said non-rotating plates and rotatable for refining paper stock therebetween, comprising the steps of, by use of magnetic bearings, supporting said rotor for rotation in said housing, measuring a refiner gap between the rotating refiner plate and at least one of said non-rotating refiner plates, and controlling said magnetic bearings to support said rotor at a predetermined axis of rotation.

8. The method of claim 7 further comprising the step of, by use of magnetic bearings, controlling said rotor axially with respect to said non-rotating refiner plates simultaneously with controlling said rotor radially with respect to said non-rotating refiner plates.

9. The method according to claim 8 in which said refiner has at least one movable stator wall supporting some of said non-rotating refiner plates further comprising the step of, by use of a magnetic bearing, positioning said movable stator wall axially with respect to said rotor to vary the refiner gap therebetween.

* * * * *